US010678166B2

(12) United States Patent
Suenaga

(10) Patent No.: US 10,678,166 B2
(45) Date of Patent: Jun. 9, 2020

(54) DEVELOPER CONTAINER

(71) Applicant: Konica Minolta Inc., Tokyo (JP)

(72) Inventor: Takenori Suenaga, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/565,980

(22) Filed: Sep. 10, 2019

(65) Prior Publication Data

US 2020/0089144 A1 Mar. 19, 2020

(30) Foreign Application Priority Data

Sep. 13, 2018 (JP) ..... 2018-171214

(51) Int. Cl.
*G03G 15/08* (2006.01)

(52) U.S. Cl.
CPC ..... *G03G 15/0889* (2013.01); *G03G 15/0867* (2013.01)

(58) Field of Classification Search
CPC ..... G03G 15/0865; G03G 15/0867; G03G 15/0872; G03G 15/0877
USPC ..... 399/262
See application file for complete search history.

(56) References Cited

U.S. PATENT DOCUMENTS 6,259,877 B1 * 7/2001 Taniyanna et al. ..... G03G 15/0872 399/262
9,411,266 B2 * 8/2016 Shinohara et al. ..... G03G 15/0877

FOREIGN PATENT DOCUMENTS

JP 2015045815 A 3/2015

* cited by examiner

*Primary Examiner* — William J Royer
(74) *Attorney, Agent, or Firm* — Cantor Colburn LLP

(57) ABSTRACT

A developer container includes: a container body storing a developer, and having an opening at an end on a downstream side in a conveyance direction for conveying the developer, a side wall having a circular cross section perpendicular to the conveyance direction, and a first protrusion spirally continuing in a continuous manner or at certain intervals toward the downstream side in a specific winding direction and provided on an inner surface of the side wall; a discharge member having a connection part fixed to the opening and a discharge port from which the developer is discharged; and a regulation member having a curved surface member with a cross section perpendicular to the conveyance direction on an upstream side of the connection part, and a second protrusion spirally continuing to the downstream side in the specific winding direction and provided on an outer surface of the curved surface member.

8 Claims, 11 Drawing Sheets

DEVELOPER CONTAINER

CROSS REFERENCE TO RELATED APPLICATIONS

The present application claims priority under 35 U.S.C. § 119 to Japanese patent Application No. 2018-171214, filed on Sep. 13, 2018, is incorporated herein by reference in its entirety.

BACKGROUND

Technological Field

The present invention relates to a developer container used in an electrophotographic image forming apparatus.

Description of the Related Art

An electrophotographic image forming apparatus forms a toner image on a photoreceptor, an intermediate transfer belt, or the like, and transfers, by a transfer unit, the formed toner image to a sheet. The transferred toner image is then fixed to the sheet by a fixing unit.

In the image forming apparatus, a developer container that supplies a developer to a developing unit is mounted. The developer container stores a developer containing toner and carrier. In many cases, a developer container having a container body disposed laterally with respect to the image forming apparatus is used. The developer container is sometimes referred to as a "toner bottle".

A spiral protrusion is provided on an inner peripheral surface of the container body to convey the stored developer. By rotation of the container body, the stored developer is conveyed to a discharge port provided at a front end of the container body and is discharged to the developing unit.

The greater an amount of the developer stored in the container body, the greater an amount of the developer conveyed to the discharge port tends to be than an amount of the developer discharged from the discharge port. As a result, a density of the developer tends to increase in a space in the vicinity of the discharge port, and a fluidity of the developer tends to decrease. Thus, it becomes difficult for the developer to be discharged from the discharge port.

To address this, a developer container disclosed in JP 2015-45815 A has been proposed. The developer container includes a container body, a discharge member, and a regulation member. The regulation member is disposed in a space formed by the container body and the discharge member, and divides the space into a storage space for storing a developer in the container body and a discharge side space for storing the developer discharged from a discharge port. The regulation member forms a passage hole through which the developer passes, and regulates an amount of the developer conveyed from the storage space to the discharge side space.

According to the developer container disclosed in JP 2015-45815 A, when the developer has a certain range of fluidity, it is possible to prevent the developer from being aggregated in the vicinity of the discharge port, and from being hardly discharged from the discharge port.

However, when the developer contains toners having different fluidity, the developer may be hardly discharged from the discharge port.

SUMMARY

In view of the above problem, an object of the present invention is to reduce, as compared with a conventional case, aggregation of a developer having a certain fluidity in the vicinity of a discharge port, when the developer is discharged from a developer container.

To achieve the abovementioned object, according to an aspect of the present invention, a developer container reflecting one aspect of the present invention comprises: a container body that stores a developer, and has an opening at an end on a downstream side in a conveyance direction for conveying the developer, a side wall having a circular cross section perpendicular to the conveyance direction, and a first protrusion spirally continuing in a continuous manner or at certain intervals toward the downstream side in a specific winding direction and provided on an inner surface of the side wall; a discharge member that has a connection part fixed to the opening and a discharge port from which the developer is discharged; and a regulation member that has a curved surface member with a cross section perpendicular to the conveyance direction on an upstream side of the connection part, and a second protrusion spirally continuing to the downstream side in the specific winding direction and provided on an outer surface of the curved surface member.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

Figure 1:
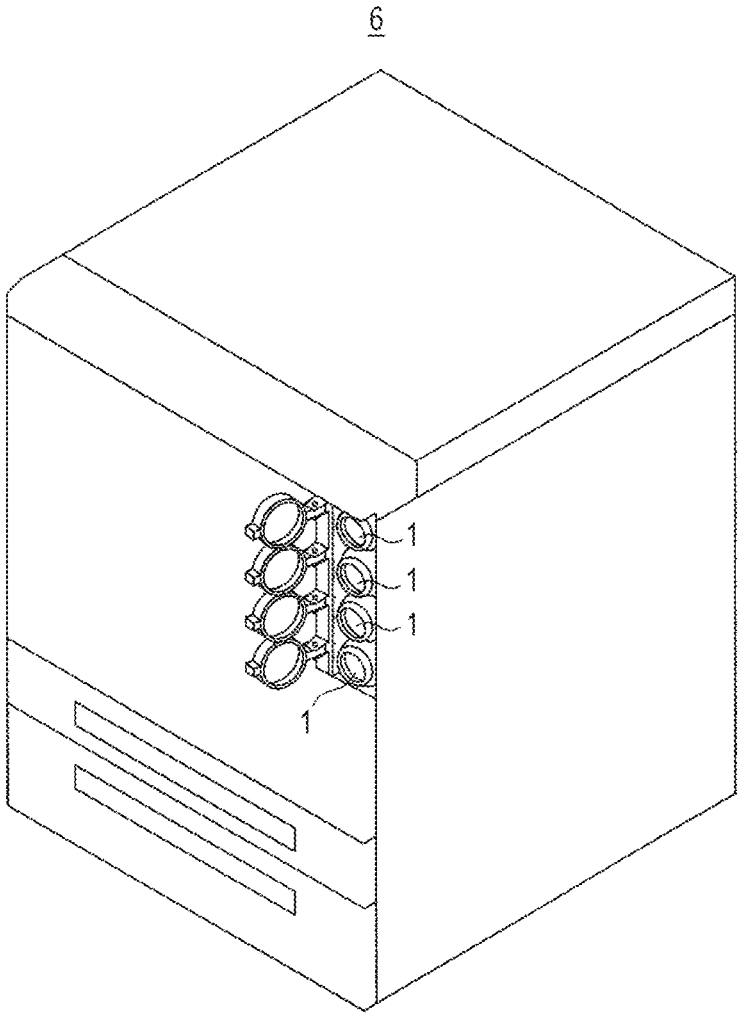
FIG. 1 is a view illustrating an example of an appearance of an image forming apparatus.
Figure 2:
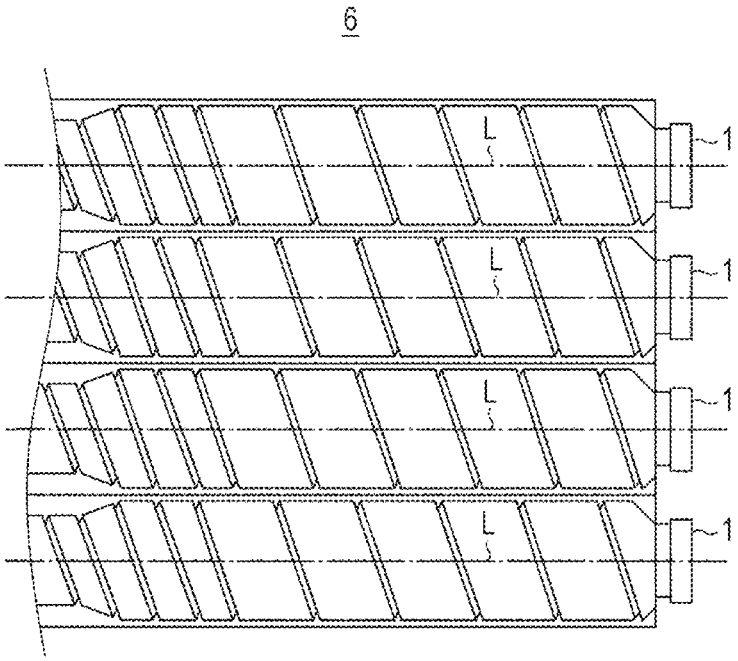
FIG. 2 is a view illustrating an example of a state when developer containers are set in the image forming apparatus.

FIG. 1 is a view illustrating an example of an appearance of an image forming apparatus 6. FIG. 2 is a view illustrating an example of a state when developer containers 1 are set in the image forming apparatus 6.

The image forming apparatus 6 illustrated in FIG. 1 is an electrophotographic image forming apparatus such as a multifunction machine, a copying machine, a printer, or a facsimile terminal, and prints an image on a sheet by using toners of four colors of cyan, magenta, yellow, and black. In the image forming apparatus 6, one developer container 1 is mounted for each of the four colors, and one developer for each of the four colors is supplied from each of the developer containers 1. The developer mainly contains a toner and a carrier.

As illustrated in FIG. 2, the developer container 1 is mounted in the image forming apparatus 6 so that a longitudinal direction of the developer container 1 is substantially horizontal. The developer container 1 then supplies the developer to the image forming apparatus 6 while rotating about a rotation axis L.

The developer containers 1 of cyan, magenta, yellow, and black have the same configuration. Hereinafter, the configuration and operation of the developer container 1 will be described by taking the developer container 1 of a specific color as an example.

[Configuration of Developer Container 1]

Figure 3:
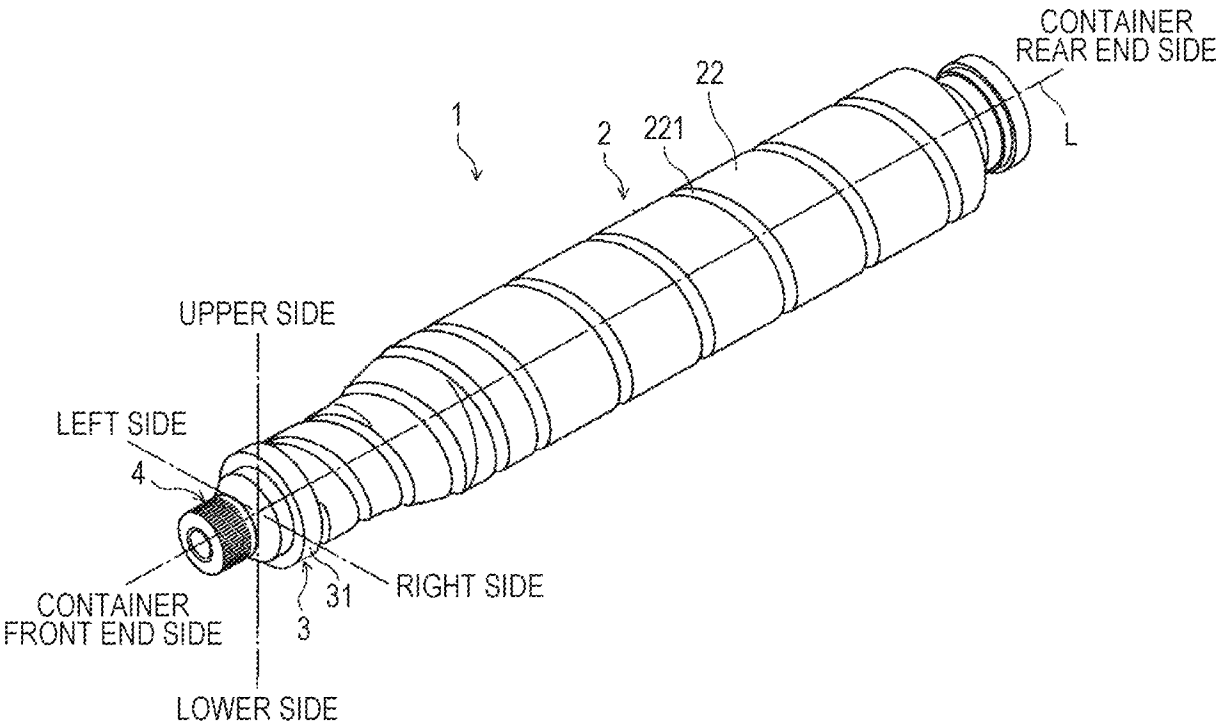
FIG. 3 is a perspective view illustrating an example of an appearance of the developer container.
Figure 4:
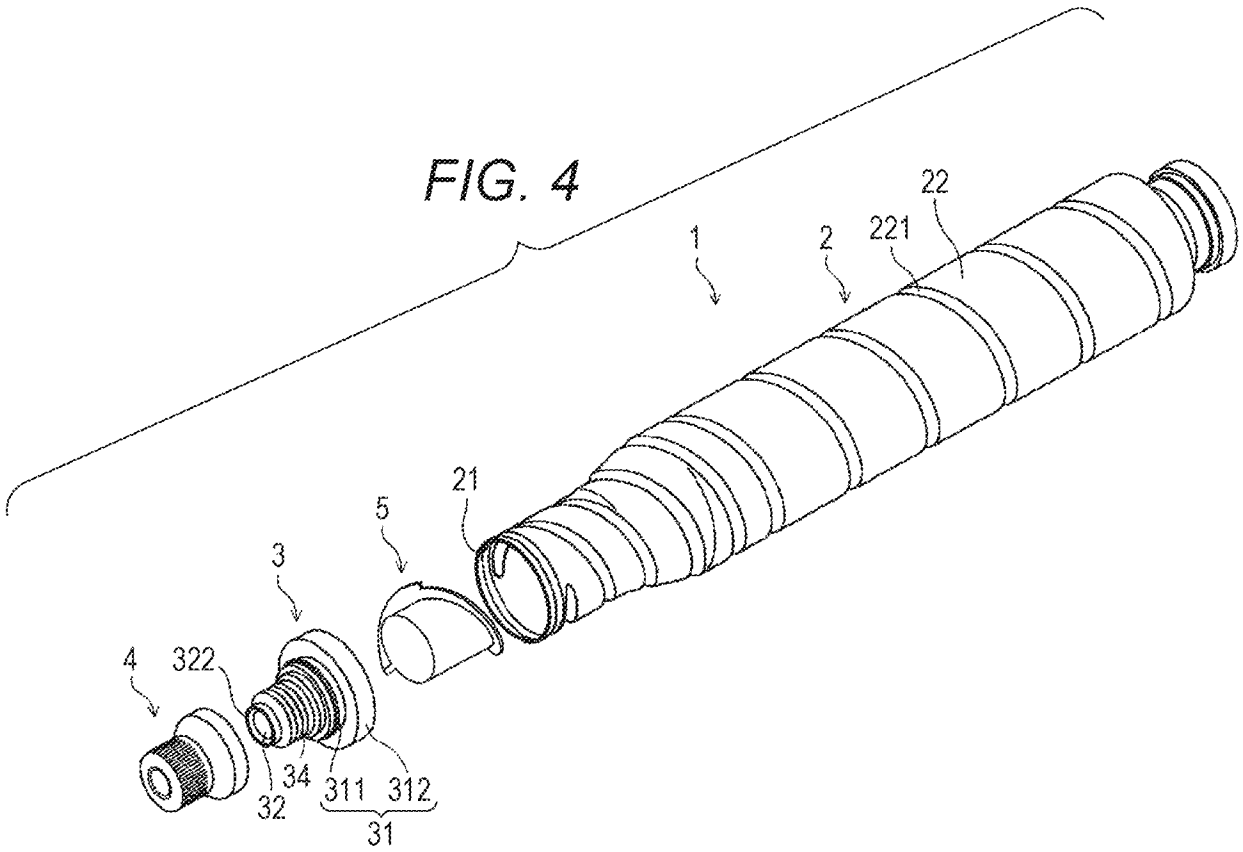
FIG. 4 is a view illustrating an example of a state where the developer container is disassembled.

FIG. 3 is a perspective view illustrating an example of an appearance of the developer container 1. FIG. 4 is a view illustrating an example of a state where the developer container 1 is disassembled.

As illustrated in FIG. 3 or 4, the developer container 1 includes a container body 2, a discharge member 3, a cap 4, and a regulation member 5. Hereinafter, an end of the developer container 1, on which the cap 4 is provided, is referred to as a "container front end", and an end opposite to the container front end is referred to as a "container rear end".

The discharge member 3 is attached to a container front end side of the container body 2. The cap 4 is attached to a container front end side of the discharge member 3. The regulation member 5 is provided between the container body 2 and the discharge member 3.

[Container Body 2]

The container body 2 stores a developer. The container body 2 is formed in a hollow, substantially cylindrical shape, and an opening 21 is provided on the container front end side. On a side wall 22 of the container body 2, a protrusion 221 protruding toward the inside of the container body 2 is formed spirally in a continuous manner or at certain intervals. The protrusion 221 is formed from an end on a container rear end side to an end on the container front end side of the side wall 22. A spiral direction (winding direction) of the protrusion 221 is set to correspond to a rotation direction of the container body 2.

When the container body 2 rotates about the rotation axis L, the protrusion 221 conveys the developer stored in the container body 2 to the opening 21. However, the opening 21 is provided with the discharge member 3 and the regulation member 5, and an amount of the developer passing through the opening 21 is restricted by the discharge member 3 and the regulation member 5, as described later.

[Discharge Member 3]

Figure 5:
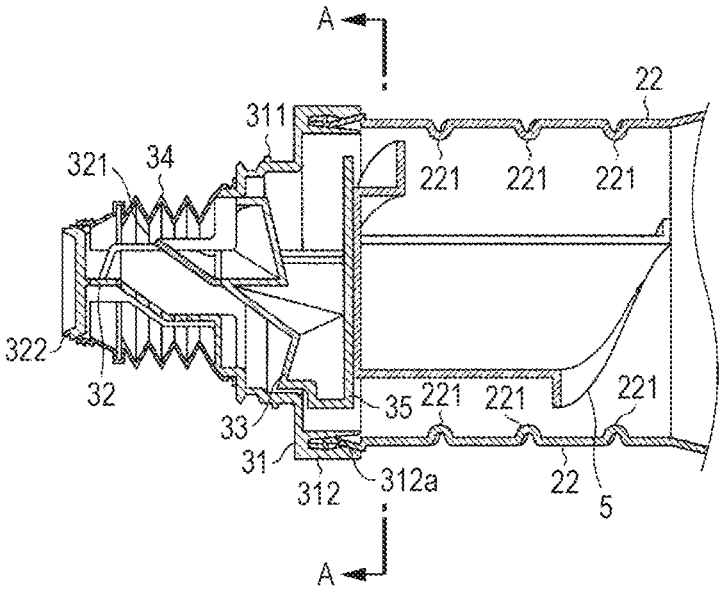
FIG. 5 is a cross-sectional view in which a front end of a container body and the vicinity thereof, a discharge member, and a regulation member are cut in parallel with a rotation axis and perpendicular to a horizontal plane.
Figure 6:
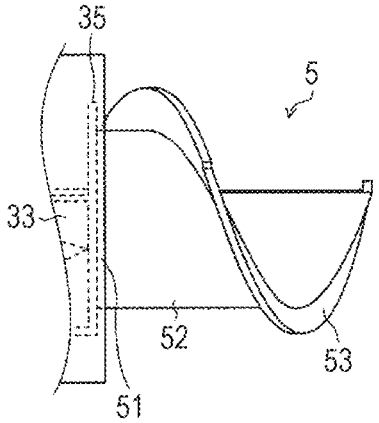
FIG. 6 is a side view illustrating an example of a connection part and the regulation member.
Figure 7:
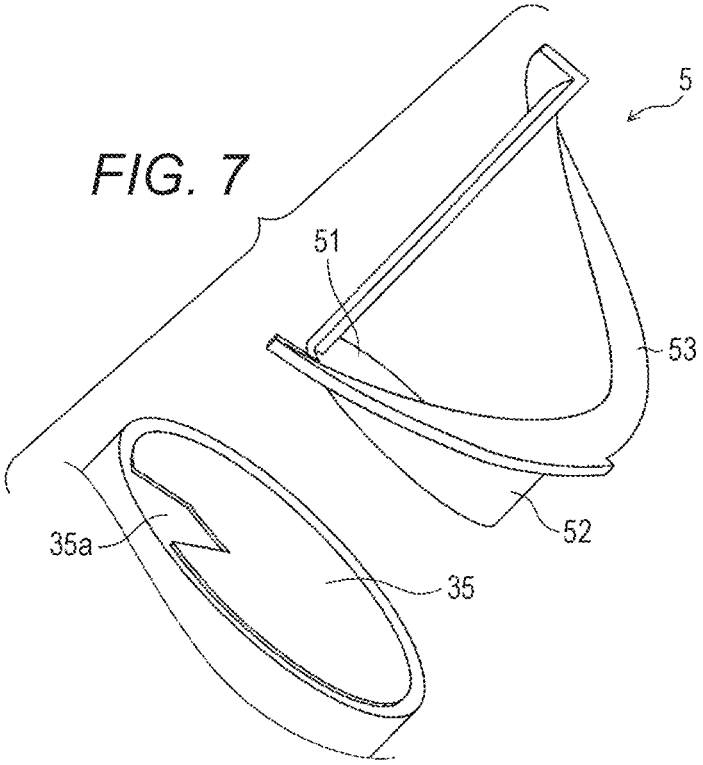
FIG. 7 is a perspective view illustrating the connection part and the regulation member separated from each other.
Figure 8:
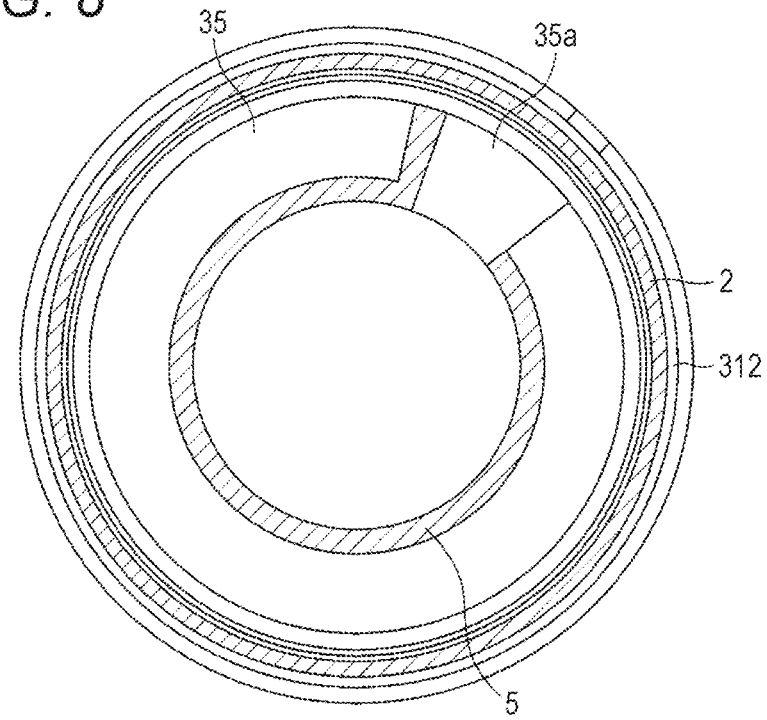
FIG. 8 is a cross-sectional view taken along line A-A of FIG. 5.
Figure 9A:
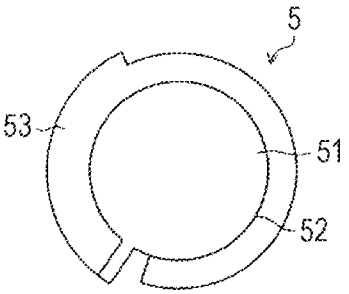
FIG. 9A to FIG. 9F are six views of the regulation member.
Figure 9B:
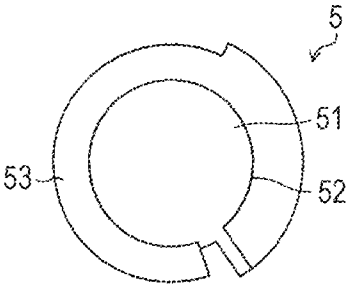
Figure 9C:
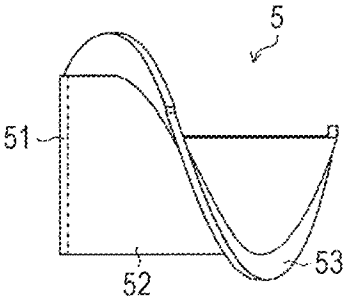
Figure 9D:
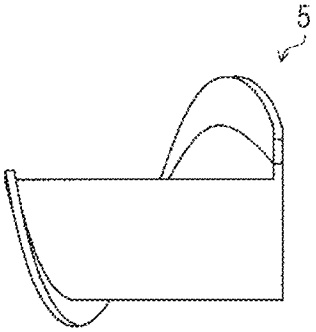
Figure 9E:
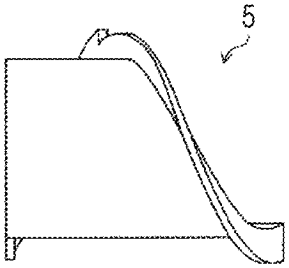
Figure 9F:
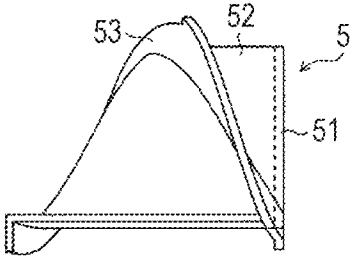

FIG. 5 is a cross-sectional view in which a front end of the container body 2 and the vicinity thereof, the discharge member 3, and the regulation member 5 are cut in parallel with the rotation axis L and perpendicular to a horizontal plane. FIG. 6 is a side view illustrating an example of a connection part 35 and the regulation member 5. FIG. 7 is a perspective view illustrating the connection part 35 and the regulation member 5 separated from each other. FIG. 8 is a cross-sectional view taken along line A-A of FIG. 5.

The discharge member 3 is attached to the container body 2 so as to close the opening 21 of the container body 2. As illustrated in FIG. 5, the discharge member 3 includes a mouth 31, a discharge part 32, a conveyance blade 33, a cover 34, and the connection part 35.

The mouth 31 has a shape in which two cylinders are stacked so that the centers of the cylinders coincide with each other, and a radius of the cylinder on the container front end side is shorter than that of the cylinder on the container rear end side. The mouth 31 has a screw part 311 on a side surface of the cylinder on the container front end side and a locking part 312 on a side surface of the cylinder on the container rear end side.

The screw part 311 is screwed with a screw groove provided inside the cap 4. Inside the locking part 312, a locking groove 312*a* formed from a rear end toward the container front end side of the mouth 31 is provided. The front end of the container body 2 is inserted into the locking groove 312*a*. In this way, the locking part 312 locks with the front end of the container body 2. With this configuration, the discharge member 3 rotates integrally with the container body 2. The discharge part 32 is provided at a front end of the mouth 31.

The discharge part 32 has a discharge port 321 through which the developer is discharged out of the container, and a hook part 322. The hook part 322 is formed in a substantially disk shape. A front end of the cover 34 described later is temporarily hooked to the hook part 322. The conveyance blade 33 is provided at a rear end of the discharge part 32.

The conveyance blade 33 is provided in the discharge part 32 and is disposed in a cylinder hole of the mouth 31. The conveyance blade 33 has a front end continuous with the discharge port 321 of the discharge part 32, and a rear end close to an inner wall of the mouth 31. When the container body 2 and the mouth 31 rotate, the conveyance blade 33 scrapes the developer sent from the container body 2 and conveys the developer to the discharge port 321 of the discharge part 32. With this configuration, even when an amount of the developer becomes small, the developer can be efficiently discharged from the discharge port 321.

The cover 34 is formed as a substantially cylindrical bellows member. The front end of the cover 34 is hooked to and stopped at the hook part 322 of the discharge part 32. A rear end of the cover 34 is fixed to the front end of the mouth 31.

As illustrated in FIG. 6, FIG. 7, and FIG. 8, the connection part 35 is formed integrally with the conveyance blade 33 and provided on a rear end side of the mouth 31.

The connection part 35 is formed in a substantially disk shape, and has a through notch 35*a* in parallel with the rotation axis L at a specific position on a periphery. A diameter of the connection part 35 is set smaller than that of the mouth 31 on the container rear end side.

In a state before the developer container 1 is mounted in the image forming apparatus 6, the cover 34 covers the discharge port 321 of the discharge part 32. With this configuration, it is possible to prevent the developer from leaking out of the discharge port 321 before the developer container 1 is mounted in the image forming apparatus 6. When the developer container 1 is mounted in the image forming apparatus 6, the front end of the cover 34 is detached from the hook part 322 and is contracted toward the container rear end side. As a result, the discharge port 321 of the discharge part 32 is exposed.

[Cap 4]

As illustrated in FIG. 4, the cap 4 is formed in a hollow, substantially frusto-conical shape. An inner wall of the cap 4 is provided with the screw groove screwed with the screw part 311 of the mouth 31. Before the developer container 1 is mounted in the image forming apparatus 6, the cap 4 is attached to the discharge member 3 so as to cover the cover 34 (see FIG. 5), as illustrated in FIG. 3. When the developer container 1 is mounted in the image forming apparatus 6, the cap 4 is detached from the discharge member 3.

[Regulation Member 5]

Figure 10A:
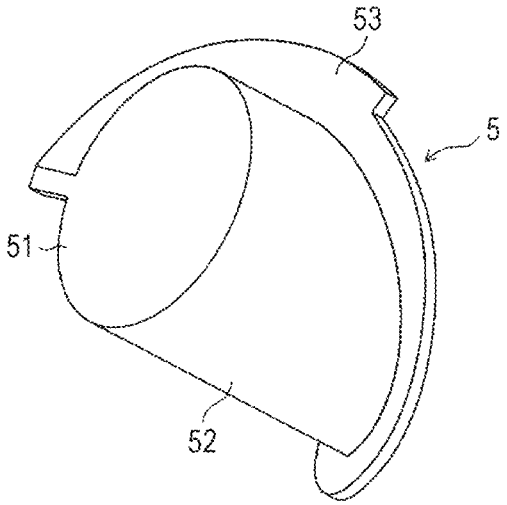
FIG. 10A and FIG. 10B are perspective views of the regulation member.
Figure 10B:
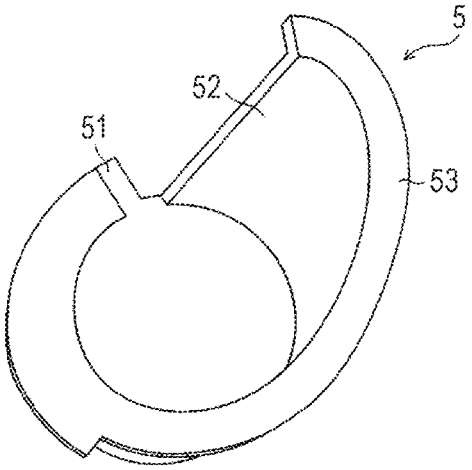
Figure 11A:
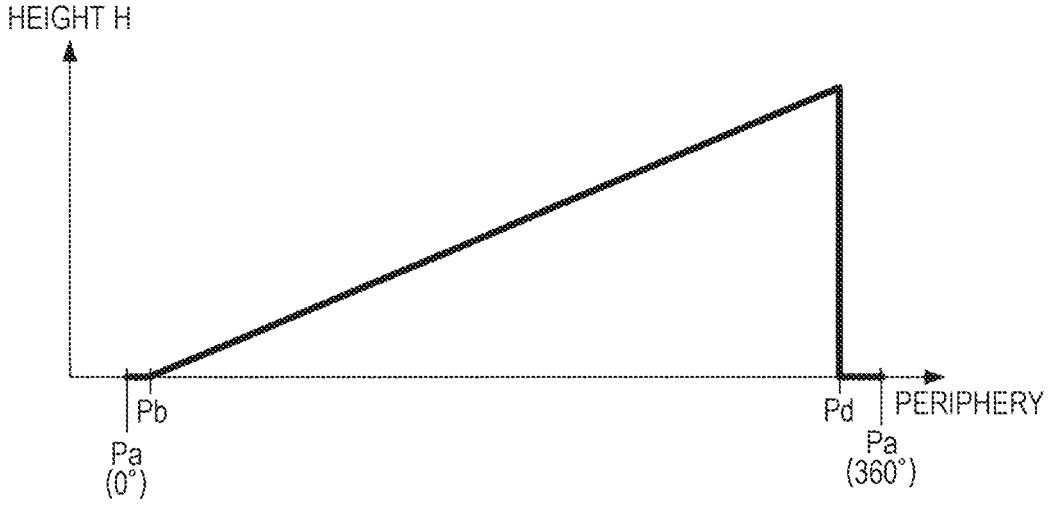
FIG. 11A and FIG. 11B are graphs showing characteristics of each of a side wall and a guide.
Figure 11B:
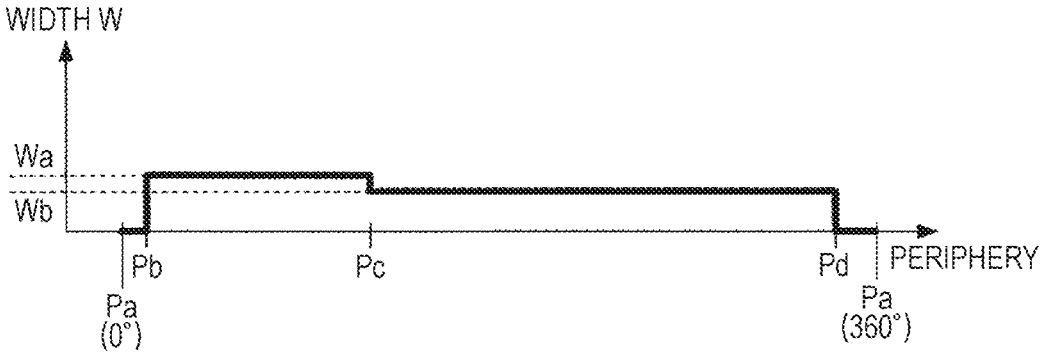

FIG. 9A to FIG. 9F are six views of the regulation member 5. FIG. 10A and FIG. 10B are perspective views of the regulation member 5. FIG. 11A and FIG. 11B are graphs showing characteristics of each of a side wall 52 and a guide 53.

As illustrated in FIG. 9A to FIG. 9F and FIG. 10A and FIG. 10B, the regulation member 5 includes a bottom surface 51, the side wall 52, and the guide 53.

The bottom surface 51 is formed in a circular flat plate shape. A diameter of the bottom surface 51 is set smaller than that of the connection part 35.

The side wall 52 has a shape in which a side surface of a cylinder is spirally cut out, and is formed integrally with the bottom surface 51. Specifically, when viewed from the container front end side, a height H of the side wall 52 from the bottom surface 51 gradually increases clockwise from a certain point Pb on a periphery of the bottom surface 51, as illustrated in FIG. 11A. Note that the height H is zero in a section between a point Pa and the point Pb and a section between a point Pd and the point Pa.

The guide 53 is formed as a spiral elongated slope on an outer side of an end of the side wall 52 opposite to the bottom surface 51. As illustrated in FIG. 11B, a width W of the bottom surface 51 is a width Wa in a section from a point corresponding to the point Pb to a point corresponding to a point Pc, and a width Wb in a section from the point corresponding to the point Pc to a point corresponding to the point Pd. Here, the width Wa>the width Wb.

A spiral direction (winding direction) and pitch of the guide 53 are the same as those of the protrusion 221. The number of turns of a spiral of the guide 53 is less than one.

The bottom surface 51 is stacked on and fixed to the connection part 35 of the discharge member 3 so that the center of the bottom surface 51 and the center of the connection part 35 coincide with each other, and the rotation axis L passes through the center of the bottom surface 51 and the center of the connection part 35. Thus, when the container body 2 rotates, the regulation member 5 rotates integrally with the container body 2 and the discharge member 3 about a perpendicular line passing through the center of the bottom surface 51.

[Developer Discharge Operation]

Figure 12:
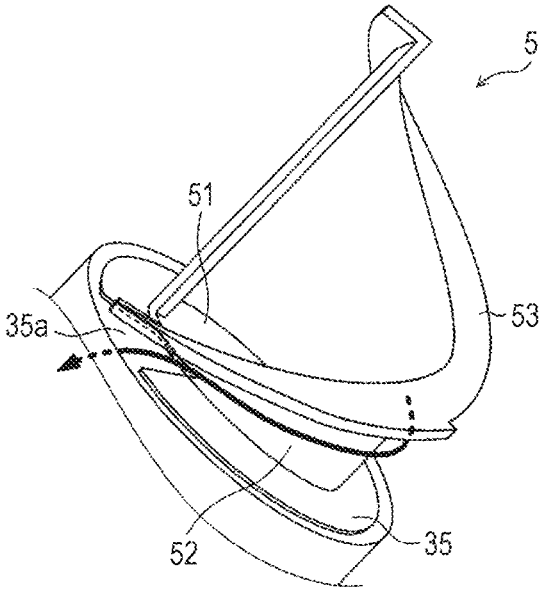
FIG. 12 is a view illustrating an example of a flow of a developer in the regulation member and the vicinity thereof.

FIG. 12 is a view illustrating an example of a flow of the developer in the regulation member 5 and the vicinity thereof.

Next, an operation of discharging the developer in the developer container 1 will be described with reference to FIG. 12 and the like.

The container body 2 is filled with the developer in advance, and the regulation member 5 is attached to the discharge member 3. The cap 4 is then detached from the developer container 1, and the developer container 1 is mounted in the image forming apparatus 6. At this time, in conjunction with the mounting, the front end of the cover 34 is detached from the hook part 322 and contracts to a rear end side, and the discharge port 321 of the discharge part 32 is exposed.

When the container body 2 rotates about the rotation axis L, the discharge member 3 also rotates integrally with the container body 2. The developer is then gradually conveyed by the protrusion 221 from the container body 2 to the discharge member 3 in the following manner.

As illustrated in FIG. 5, the connection part 35 and the regulation member 5 are provided in the vicinity of the opening 21 of the container body 2. Thus, a part of the developer conveyed by the protrusion 221 comes into contact with the bottom surface 51 of the regulation member 5 or the connection part 35, and the conveyance is regulated.

However, as illustrated in FIG. 12, a certain amount of the developer conveyed by the protrusion 221 is conveyed to the discharge member 3 along the side wall 52 and the guide 53.

The certain amount of the developer passes through the notch 35*a* of the connection part 35, is conveyed to the discharge port 321 by the conveyance blade 33, and is discharged from the discharge port 321.

According to the present embodiment, it is possible to reduce, as compared with a conventional case, aggregation of a developer having a certain fluidity in the vicinity of a discharge port when the developer is discharged from the developer container 1. With this configuration, occurrence of a decrease in density of an image caused by a defective discharge of the developer or formation of aggregates can be more reliably suppressed than in a conventional case. In particular, since the discharge is stabilized even in a state where the developer container 1 is densely filled with the developer, more developer can be contained in the developer container 1 than in a conventional case.

[Modification]

Figure 13:
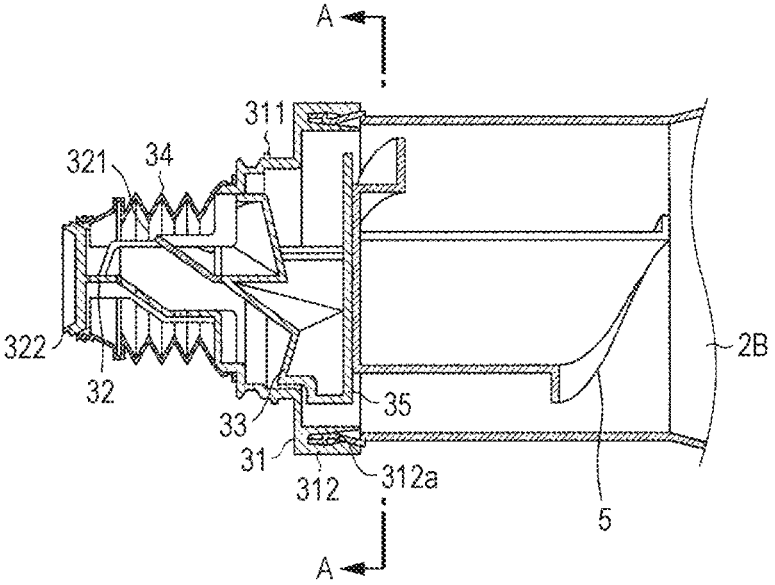
FIG. 13 is a view illustrating a modification of a protrusion of the container body.
Figure 14:
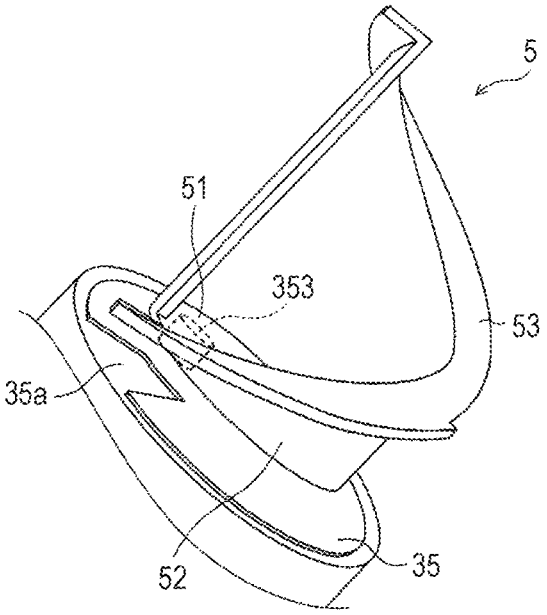
FIG. 14 is a view illustrating a modification of how the discharge member and the regulation member are connected.

FIG. 13 is a view illustrating a modification of the protrusion 221 of the container body 2. FIG. 14 is a view illustrating a modification of how the discharge member 3 and the regulation member 5 are connected.

In the present embodiment, the protrusion 221 is formed from the end on the container rear end side to the end on the container front end side of the side wall 22 of the container body 2. That is, as illustrated in FIG. 5, the protrusion 221 is formed substantially to the opening 21. As illustrated in FIG. 13, however, it may be possible that the protrusion 221 is not formed on a portion of the side wall 22, which is in the vicinity of the end on the container front end side and in parallel with the regulation member 5. That is, the protrusion 221 may be formed from the end on the container rear end side of the side wall 22 to an end on the container rear end side of the regulation member 5.

In the present embodiment, as illustrated in FIG. 5, the regulation member 5 is provided on the connection part 35 so that the bottom surface 51 is in contact with the connection part 35. As illustrated in FIG. 14, however, the regulation member 5 may be provided slightly apart from the connection part 35. In this case, a column 353 may be provided from the connection part 35 toward the container rear end side, and the regulation member 5 may be fixed to the column 353.

In the present embodiment, the inside of the side wall 52 of the regulation member 5 is hollow, but the inside of the side wall 52 may be dense.

In the present embodiment, a portion of the side wall 52 upstream of the guide 53 is missing, but the portion may not be missing. That is, for example, a cylinder may be used as the side wall 52 without being cut out, and the guide 53 may be spirally provided on an outer side of the side wall 52.

In the present embodiment, the number of turns of the spiral of the guide 53 is less than one, but the number of turns may be one or more.

In the present embodiment, the protrusion 221 is formed so that a part of the side wall 22 is recessed inward, but the protrusion 221 may be formed inside the side wall 22 without providing a recess on the outer side of the side wall 22.

In addition, the configuration of the whole or each part of the developer container 1 can be appropriately changed in accordance with the spirit of the present invention.

Although embodiments of the present invention have been described and illustrated in detail, the disclosed embodiments are made for purposes of illustration and example only and not limitation. The scope of the present invention should be interpreted by terms of the appended claims.

What is claimed is:

1. A developer container comprising:

a container body that stores a developer, and has an opening at an end on a downstream side in a conveyance direction for conveying the developer, a side wall having a circular cross section perpendicular to the conveyance direction, and a first protrusion spirally continuing in a continuous manner or at certain intervals toward the downstream side in a specific winding direction and provided on an inner surface of the side wall;

a discharge member that has a connection part fixed to the opening and a discharge port from which the developer is discharged; and a regulation member that has a curved surface member with a cross section perpendicular to the conveyance direction on an upstream side of the connection part, and a second protrusion spirally continuing to the downstream side in the specific winding direction and provided on an outer surface of the curved surface member.

2. The developer container according to claim 1, wherein the number of turns of the second protrusion is less than one.

3. The developer container according to claim 1, wherein pitch of the first protrusion and pitch of the second protrusion are the same.

4. The developer container according to claim 1, wherein the first protrusion is provided from an end on the upstream side to the opening of the container body.

5. The developer container according to claim 1, wherein the first protrusion is provided from an end on the upstream side of the container body to an end of the upstream side of the second protrusion.

6. The developer container according to claim 1, wherein the connection part has a hole for allowing the developer to pass through near an end on the downstream side of the second protrusion.

7. The developer container according to claim 1, wherein the curved surface member is provided without a space between the curved surface member and the connection part.

8. The developer container according to claim 1, wherein the curved surface member is provided with a space between the curved surface member and the connection part.

* * * * *